US007900494B1

(12) United States Patent
Chavez

(10) Patent No.: US 7,900,494 B1
(45) Date of Patent: Mar. 8, 2011

(54) TRAILER BED FRAME STRAIGHTENER

(76) Inventor: Isidro Chavez, Brentwood, CA (US)

( * ) Notice: Subject to any disclaimer, the term of this patent is extended or adjusted under 35 U.S.C. 154(b) by 945 days.

(21) Appl. No.: 11/620,015

(22) Filed: Apr. 5, 2007

(51) Int. Cl.
*B21D 37/12* (2006.01)
*B21C 1/00* (2006.01)

(52) U.S. Cl. ..... 72/455; 72/705

(58) Field of Classification Search ..... 72/413, 72/447, 457, 466.7, 705, 455, 456; 29/251
See application file for complete search history.

(56) References Cited

U.S. PATENT DOCUMENTS

| | | | | |
|---|---|---|---|---|
| 1,773,187 | A | 8/1930 | Johnson | |
| 2,442,425 | A | 6/1948 | Merrill et al. | |
| 2,717,020 | A | 9/1955 | Dobias | |
| 3,377,834 | A | 4/1968 | Latuff et al. | |
| 4,138,876 | A | 2/1979 | Chisum | |
| 4,466,268 | A | 8/1984 | Matson, Sr. | |
| 4,546,638 | A | 10/1985 | Field | |
| 4,574,614 | A * | 3/1986 | Field | 72/447 |
| 4,599,878 | A * | 7/1986 | Hudson et al. | 72/21.4 |
| 4,700,559 | A | 10/1987 | Larson et al. | |
| 5,058,286 | A * | 10/1991 | Chisum | 33/608 |
| 5,257,526 | A | 11/1993 | Teixeria | |
| 5,819,576 | A | 10/1998 | Smith, Jr. | |
| 7,104,107 | B2 * | 9/2006 | Buckler et al. | 72/447 |

FOREIGN PATENT DOCUMENTS

| | | |
|---|---|---|
| CA | 1329357 | 5/1994 |
| EP | 0172290 | 4/1984 |

* cited by examiner

*Primary Examiner* — Teresa M Bonk
(74) *Attorney, Agent, or Firm* — Michael I Kroll

(57) ABSTRACT

A device for re-shaping a trailer frame includes a support structure for receiving the trailer frame therein and means connected to the support structure for securing the trailer therein. Once secured, at least one hydraulic ram that is connected to and selectively moveable about the support structure is able to apply a predetermined force against the frame. A control device is positioned on the support structure and connected to the at least one hydraulic ram for controlling operation thereof. Upon securing the trailer via the securing means, the at least one hydraulic ram is positioned adjacent the frame and the control mechanism is selectively operable to cause the at least one hydraulic ram to apply the predetermined force on the frame thereby reshaping the frame.

15 Claims, 15 Drawing Sheets

TRAILER BED FRAME STRAIGHTENER

BACKGROUND OF THE INVENTION

1. Field of the Invention

The present invention relates generally to trailer bed frames and, more specifically, to a straightening system for trailer bed frames which have bent out of shape over time. The present invention is comprised of hydraulic rams, fastening elements, a control panel and a support structure. A bent trailer bed frame is secured to the support structure by the fastening elements. The bent trailer frame is straightened in response to the input of controls provided by the control panel. The control panel provides the user with control over the position and power of the hydraulic rams connected to the support structure. The force exerted by the hydraulic rams straightens the bent trailer frame.

2. Description of the Prior Art

There are other frame straightening devices designed for motor vehicles. Typical of these is U.S. Pat. No. 1,773,187 issued to Johnson on Aug. 19, 1930.

Another patent was issued to Merrill et al. on Jun. 1, 1948 as U.S. Pat. No. 2,442,425. Yet another U.S. Pat. No. 2,717,020 was issued to Dobias on Sep. 6, 1955 and still yet another was issued on Apr. 16, 1968 to Latuff et al. as U.S. Pat. No. 3,377,834.

Another patent was issued to Chisum on Feb. 13, 1979 as U.S. Pat. No. 4,138,876. Yet another U.S. Pat. No. 4,466,268 was issued to Matson, Sr. on Aug. 21, 1984. Another was issued to Field on Oct. 15, 1985 as U.S. Pat. No. 4,546,638 and still yet another was issued on Oct. 20, 1987 to Larson et al. as U.S. Pat. No. 4,700,559.

Another patent was issued to Teixeria on Nov. 2, 1993 as U.S. Pat. No. 5,257,526. Yet another U.S. Pat. No. 5,819,576 was issued to Smith, Jr. on Oct. 13, 1998. Another was issued to Mora Agudo on Apr. 27, 2004 as European Publication No. EP0172290 and still yet another was issued on May 10, 1994 to Gemme as Canadian Patent No. CA1,329,357.

U.S. Pat. No. 1,773,187

Inventor: Emil Johnson

Issued: Aug. 19, 1930

In a device of the class described, the combination of a support; spaced apart tubular sockets provided in said support; vertical standpipes adapted to fit into said sockets; beams having spaced apart holes there through adapted to fit over said standpipes; tool-engaging members slidable on said beams, having holes therethrough; means to hold or move certain parts of an automobile.

U.S. Pat. No. 2,442,425

Inventor: Marcellus S. Merrill

Issued: Jun. 1, 1948

In apparatus of the character described, a rigid base frame including spaced, parallel, horizontally-disposed side members and posts supporting the ends of said side members, upper and lower, transverse, parallel members connecting between said posts and between corresponding ends of said side members, means for supporting a vehicle above said side members, a plurality of units independently shiftably longitudinally of said side members and each engageable with a vehicle frame for the application of transverse pressures thereto, and a rigid, upstanding post removably engageable with the transverse members at each end of said base frame and adjustable longitudinally of said transverse members for the application of tensile stresses to the vehicle frame members simultaneously with the application of transverse pressure thereto.

U.S. Pat. No. 2,717,020

Inventor: George L. Dobias

Issued: Sep. 6, 1955

A straightening apparatus of the character described comprising a pair of elongated runways, cross braces disposed beneath and secured to the ends of said runways and supporting the runways in elevated substantially parallel positions, a base member extending transversely, beneath said runways, means slidably connecting said base member to bottom portions of the runways for supporting the base member beneath the runways for sliding movement longitudinally thereof, a pair of uprights fixed to and raising from said base member, said uprights being disposed on outer sides of the runways, a pair of fluid pressure actuated rams, means detachably connected to and rising from said base member, said uprights before adjustably supporting said rams relatively to the uprights in desired positions to engage parts of a vehicle mounted on the runways between the uprights, a second base member disposed between corresponding ends of said runways and slidably supported on the cross brace supporting said runway ends for sliding movement of said second base member transversely of the runways, means retaining said second base member against swinging movement relatively to the runways, an upright fixed to and rising from said second base member and disposed beyond said runway ends, a third fluid pressure actuated ram, and means detachably and adjustably supporting said third ram on said last mentioned upright.

U.S. Pat. No. 3,377,834

Inventor: Joseph J. Latuff

Issued: Apr. 16, 1968

A vehicle frame straightening device comprising:

(a) upper and lower guide acting frame members each being in the form of a continuous uninterrupted portion of track having corresponding sides joined by curved portions to an end;

(b) means rigidly mounting said frame members in parallel, vertically spaced apart, generally horizontal positions;

(c) a vertically elongated subframe mounted in engagement with said frame members for horizontal, longitudinal movement thereon, said subframe having a portion thereof mounted for rotation about a vertical axis;

(d) power means mounted on said subframe for imparting a straightening force to said vehicle frame; and (e) flexible connecting means for connecting said power means to said vehicle frame in cooperation with said rotatable portion of said subframe to direct the straightening force in any desired direction.

U.S. Pat. No. 4,138,876

Inventor: Finis L. Chisum

Issued: Feb. 13, 1979

A heavy duty truck liner for working on a truck, or large trailer, where a plurality of pulling and pushing operations are required to straighten a frame, etc. A plurality of tracks in the form of a rectangle surrounding the normal position of the truck and body is prepared and set into the concrete floor of the work room. A large inverted U-frame is set on rollers which are adapted to travel longitudinally along the long sides of the track. The frame is large enough to completely encircle the truck and body and can be moved readily along the track so as to be opposite any point on the side walls of the body where pulling or pushing operations are required. A folding platform is attached in a slidable manner to the sidewalls of the frame so as to position the platform at any level on either side of the body. Hydraulic locking means are provided to lock the frame in any selected position so as to withstand any pulling and pushing forces required. A plurality of robots are provided which are adapted to run on a second set of rails paralleling the first set which support the U-frame. Each of these robots is provided with a swivel table and a hydraulic crane so that it can be used to pick up loads, swing them to different positions and transport them along the rails, etc. The hydraulic crane can reach into the frame of the truck and pull, or push, as required, to provide straightening operations.

U.S. Pat. No. 4,466,268

Inventor: Robert P. Matson, Sr.

Issued: Aug. 21, 1984

A straightening apparatus for use in straightening the bent portions of vehicles including a support frame in which the vehicle is positionable; a pusher unit adjustably mounted on the support frame and adapted to engage the bent portion of the vehicle and applying a straightening force thereto in a first direction; and a backup unit adjustably mounted on the support frame and adapted to engage the vehicle in the vicinity of and in opposition to the pusher unit and apply backup forces to the vehicle oriented generally parallel to the straightening force and in a second direction opposite to the first direction so that the bent portion of the vehicle can be straightened back to its original shape without deformation of the unbent portions of the vehicle.

U.S. Pat. No. 4,546,638

Inventor: Carl R. Field

Issued: Oct. 15, 1985

An apparatus for repairing and straightening vehicles includes upper and lower tracks supported in vertically spaced relation by a frame, each track including a pair of laterally spaced apart and longitudinally extending side members. A plurality of tower assemblies are supported on the upper and lower tracks for longitudinal movement thereal-ong. A pit is provided in which cross members support rails positioned directly under side bars of a truck vehicle for a tie-down to extend around the rails and to the vehicle side bars. A longitudinally moveable beam is provided between adjacent lower tracks and the pair of rails and is limited against vertical movement by horizontal flanges facing each other on the tracks and pair of rails. A pulley on the moveable beam engages a tension member extending from the tower to the vehicle to provide a downward pull on the vehicle between the track members and the rails. The structure of the tower assembly allows for pulling on the vehicle frame only at a 90 degree angle, as the pulley on top of the cylinder is limited against turning. The chain is restricted to one side of the tower by a guide on the tower.

U.S. Pat. No. 4,700,559

Inventor: Byron A. Larson et al

Issued: Oct. 20, 1987

An apparatus for repairing a deformed, yieldable body of a motor vehicle. The apparatus includes a frame on which a raised platform is secured. To restrain the vehicle during the application of a restoring force, various appliances are attached at any location about the outer boundary of the platform and coupled to the motor vehicle. The appliances are adapted to be attachable to and releasable from the motor vehicle without requiring its movement. To apply the force necessary to restore the deformed, yieldable body of a motor vehicle, the apparatus includes pull-towers supported on and movable along a track provided by the frame. Each pull-tower includes a compact power head which can be moved vertically up or down the pull-tower. Activating the power head produces the force used in restoring the deformed, yieldable body of the motor vehicle.

U.S. Pat. No. 5,257,526

Inventor: Louis Teixeria

Issued: Nov. 2, 1993

Apparatus is disclosed for straightening the frame of a damaged vehicle and includes a bed on which the damaged vehicle is located during the frame straightening operation. A plurality of towers are mounted on the bed and are adjustably movable in a horizontal direction relative thereto. Some of the primary towers include a pushing and holding mechanism, and a pulling mechanism; while other towers include only a pushing and holding mechanism. The pushing and holding mechanism of a tower is operable to selectively push or hold a designated location of the damaged vehicle frame, and is simultaneously selectively operable with a pushing and holding mechanism and/or the pulling mechanism of towers as applied to a separate designated location of the vehicle frame to effectively straighten the frame of the vehicle.

U.S. Pat. No. 5,819,576

Inventor: Curtis A. Smith, Jr.

Issued: Oct. 13, 1998

Self-contained snowmobile straightening system with a repair table. The table includes a two-location anchoring system assuring that both the chassis and the suspension of the snowmobile are immobilized in place on the table so that repair work can be accomplished by adjustable and removable pulling equipment structurally associated with the repair table. The chassis is immobilized in place by at least one pair of opposed slide rail clamps which lock both slide rails of a snowmobile in place on the table surface of the straightening system. The snowmobile suspension system is anchored by opposed pairs of running board clamps, while pulling towers and braces, in combination with hydraulic power rams, afford a repair craftsman many necessary multi-directional pulls.

European Publication Number EP 0 172 290

Inventor: Manuel Mora Agudo

Issued: Apr. 27, 1984

The apparatus consists of a parallelepipedal framework whose support face is formed by a series of sections (1) disposed transversely to its largest dimension. At least one section is arranged each meter and a half along the length of the apparatus with a view to imparting to it the necessary rigidity, together with other sections (2) disposed vertically and assembled to the first ones, while on the upper face there are only two sections (5) which determine its largest dimension and serve as rails for a travelling crane which can track along the entire length of the apparatus, so as to make it possible to insert and remove chassis and to replace chassis bodies.

Canadian Patent Number CA1,329,357

Inventor: Jean Gemme et al.

Issued: May 10, 1994

The apparatus includes a car-supporting platform fitted with a power operated lift for lifting the vehicle off the platform, so as to facilitate inserting clamps to secure the vehicle body to the platform. One or more L-shaped pulling arms are pivoted to the platform frame for swinging movement around the vehicle body, so as to enable pulling on the latter in any horizontal orientation. In a preferred embodiment, the platform is made of two pivotal sections which can be folded against each other, and the apparatus is provided with wheels, so that the same, with the platform in folded position, can be wheeled about and stored in a minimum of space when not in use.

While these frame devices may be suitable for the purposes for which they were designed, they would not be as suitable for the purposes of the present invention, as hereinafter described.

SUMMARY OF THE PRESENT INVENTION

The present invention relates generally to trailer bed frames and, more specifically, to a straightening system for trailer bed frames which have bent out of shape over time. The present invention is comprised of hydraulic rams, fastening elements, a control panel and a support structure. A bent trailer bed frame is secured to the support structure by the fastening elements. The bent trailer frame is straightened in response to the input of controls provided by the control panel. The control panel provides the user with control over the position and power of the hydraulic rams connected to the support structure. The force exerted by the hydraulic rams straightens the bent trailer frame.

A primary object of the present invention is to provide a trailer bed frame straightener that overcomes the shortcomings of the prior art.

Another object of the present invention is to provide a device for straightening the trailer frames used for supporting cargo containers.

Still another object of the present invention is to provide a frame straightening device having a support base including base plates positioned on each side of a floor guide.

Yet another object of the present invention is to provide a frame straightening device having a plurality of fastening elements.

Still yet another object of the present invention is to provide a frame straightening device wherein stanchions are positioned at a first distal end thereof at substantially a center of each respective one of the support base plates.

Another object of the present invention is to provide a frame straightening device wherein each stanchion has a pair of divergent support members extending from a predetermined point along a length thereof to its respective support base plate.

Yet another object of the present invention is to provide a frame straightening device wherein the stanchions support an upper support beam extending therebetween and fastened thereto at a distal end opposite the first distal end.

Still yet another object of the present invention is to provide a frame straightening device wherein the stanchions and upper support beams have tracks along their lengths.

Another object of the present invention is to provide a frame straightening device wherein the stanchion and upper support beam tracks have pivotally mounted hydraulic rams connected thereto.

Still another object of the present invention is to provide a frame straightening device wherein the hydraulic rams are operated by operational control inputs from a controller.

Another object of the present invention is to provide a frame straightening device wherein the hydraulic rams traverse along the track to align with the bent trailer frame.

Yet another object of the present claimed invention is to provide a frame straightening device wherein the hydraulic rams straighten a bent trailer frame by asserting force on the frame.

Still yet another object of the present invention is to provide a frame straightening device that is simple and easy to use.

A still further object of the present invention is to provide a frame straightening device that is economical and inexpensive to manufacture.

Additional objects of the present invention will appear as the description proceeds.

The present invention overcomes the shortcomings of the prior art by providing a trailer bed frame straightener comprised of sliding and pivoting hydraulic rams, fastening elements, a control panel and a support structure. A bent trailer bed frame is secured to the support structure by the fastening elements. The bent trailer frame is straightened in response to the input of controls provided by the control panel. The control panel provides the user with control over the position and power of the hydraulic rams connected to the support structure. The force exerted by the hydraulic rams straightens the bent trailer frame.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Figure 8:
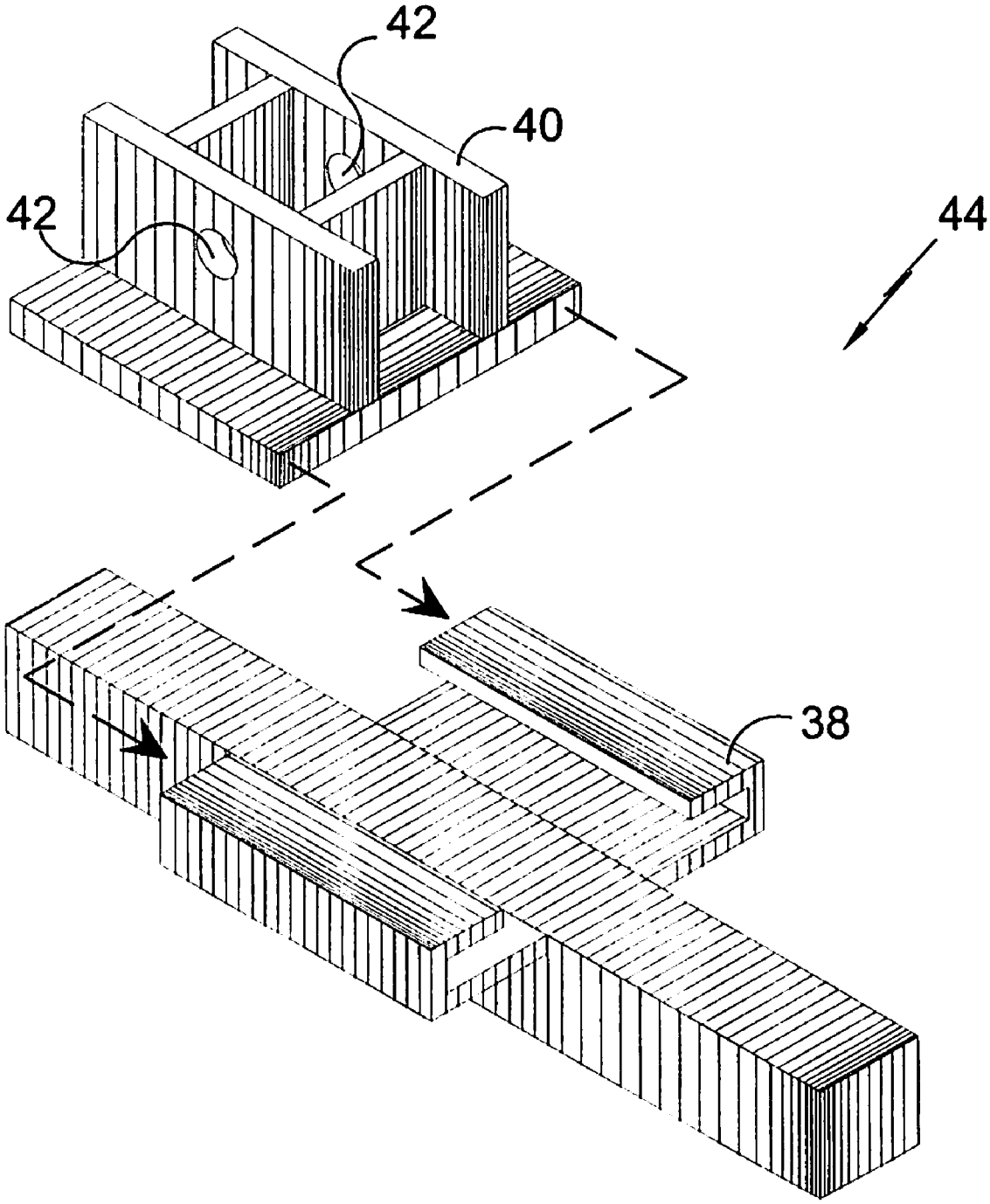
Figure 9:
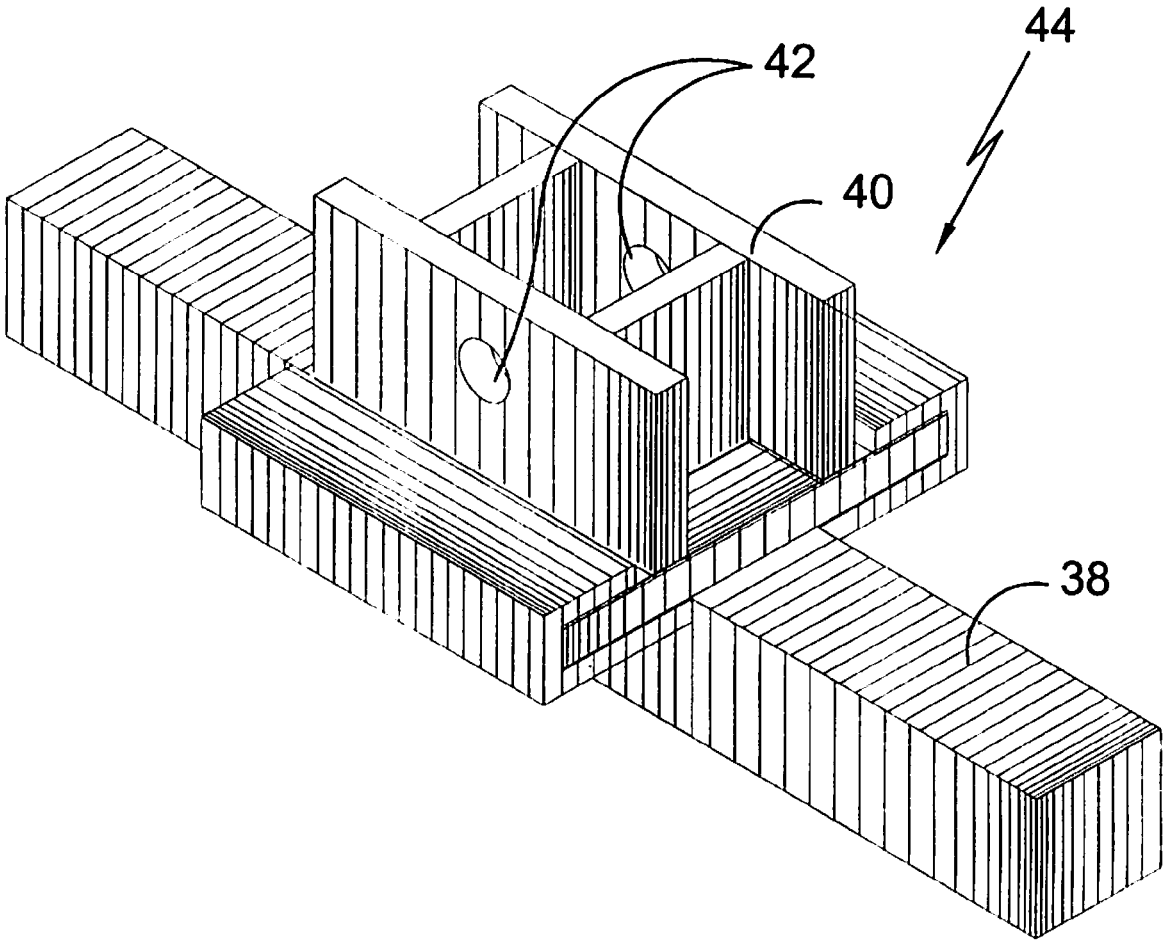
Figure 10:
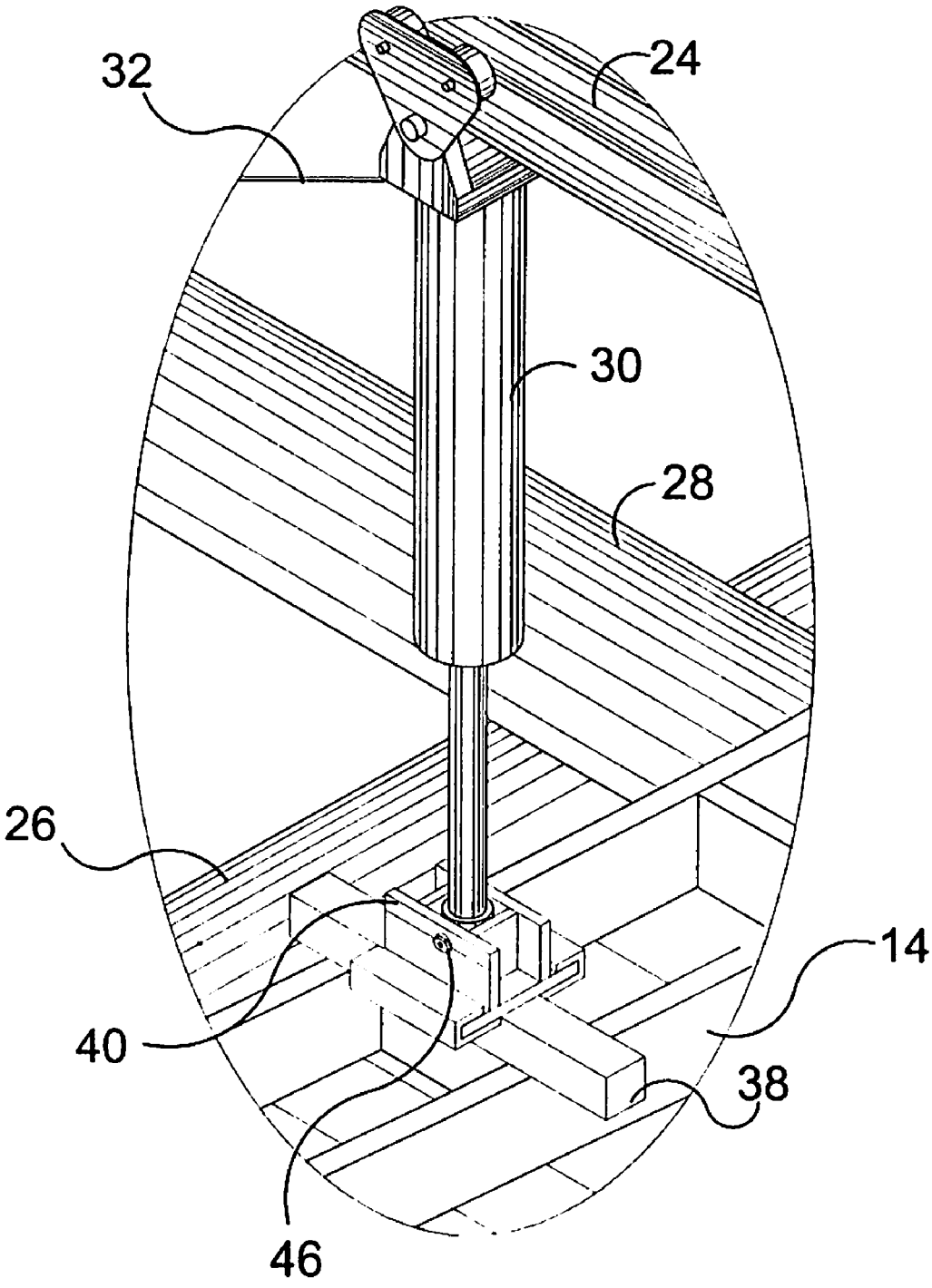
Figure 11:
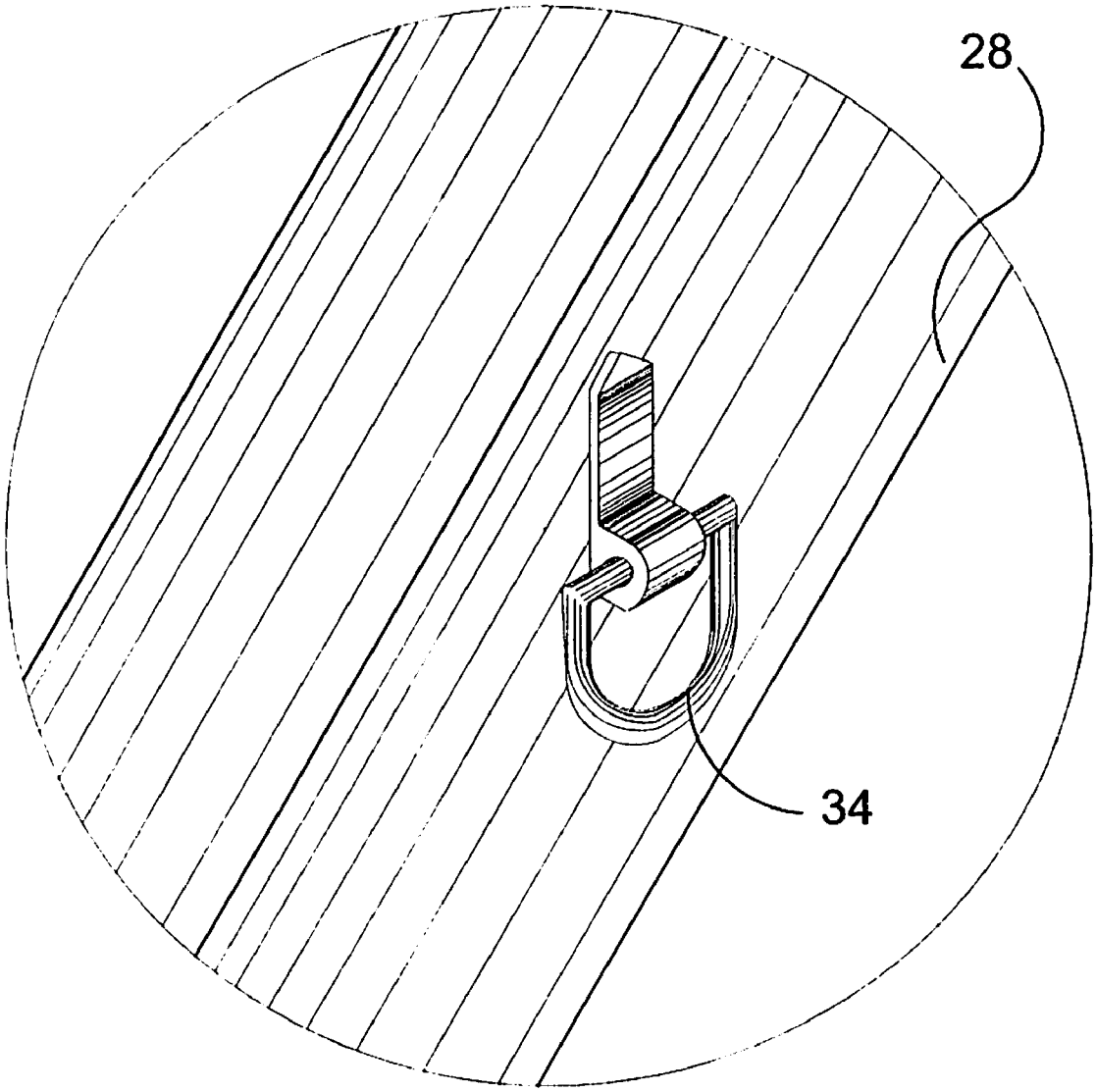
Figure 12:
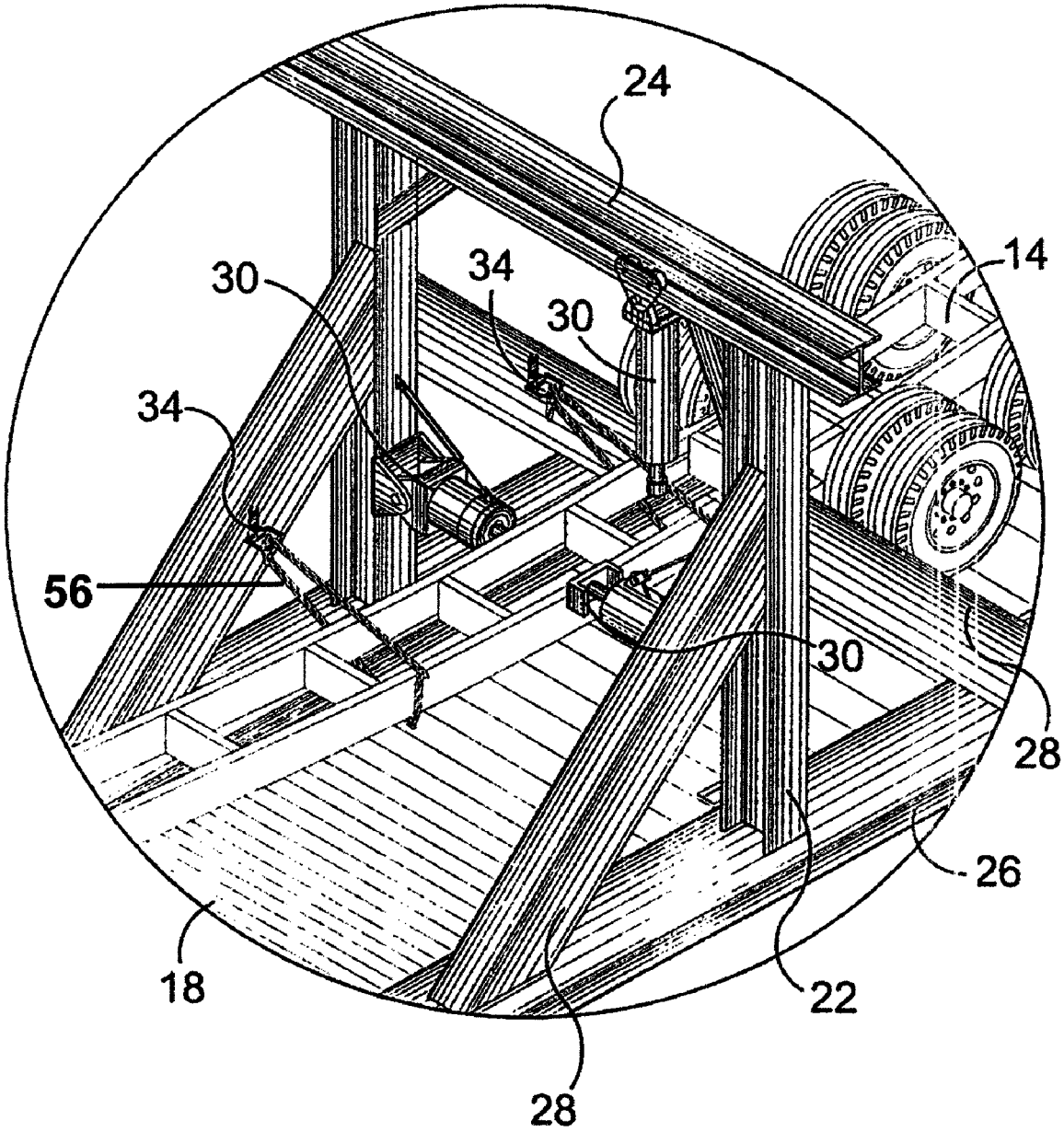
Figure 13:
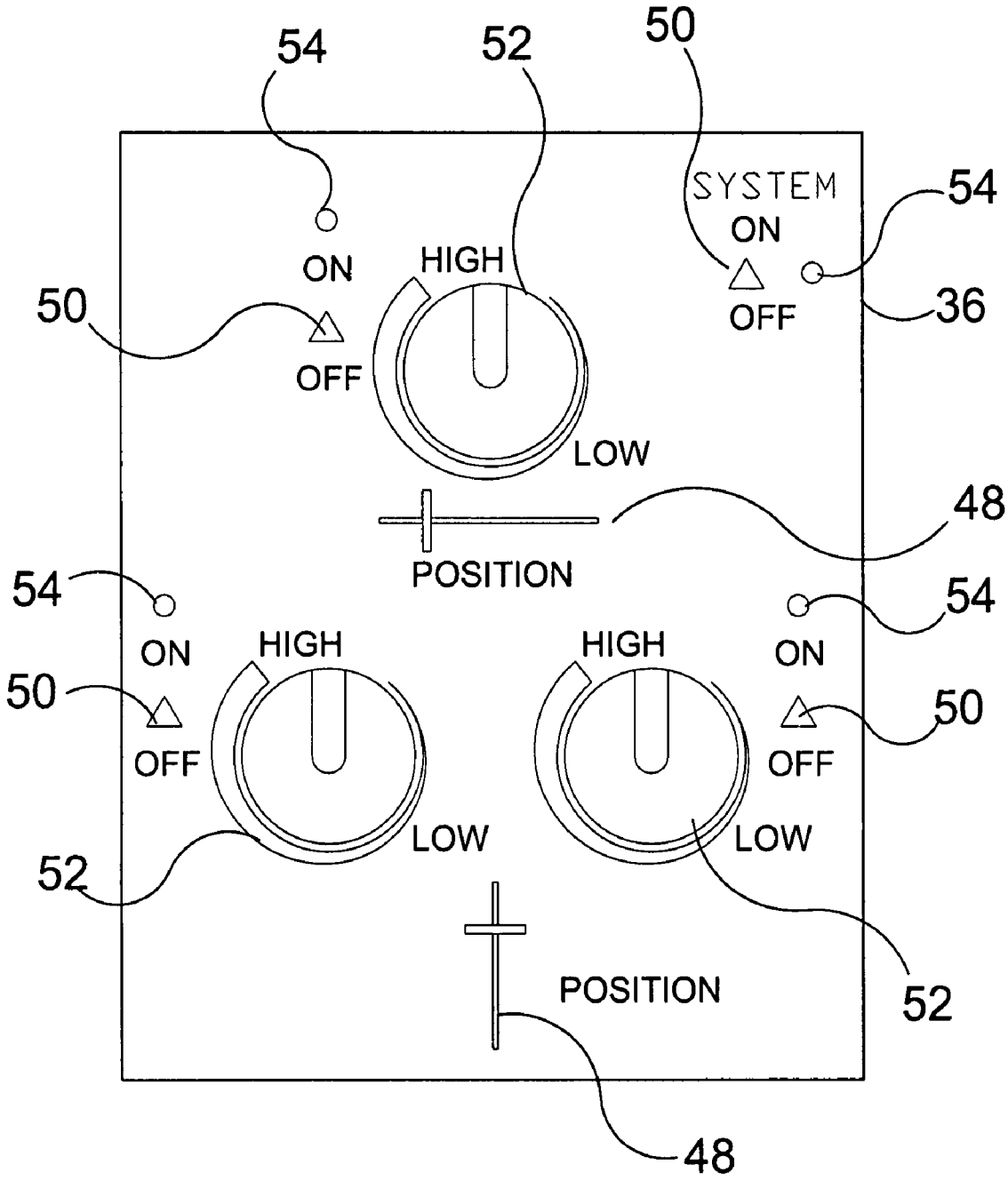
Figure 14:
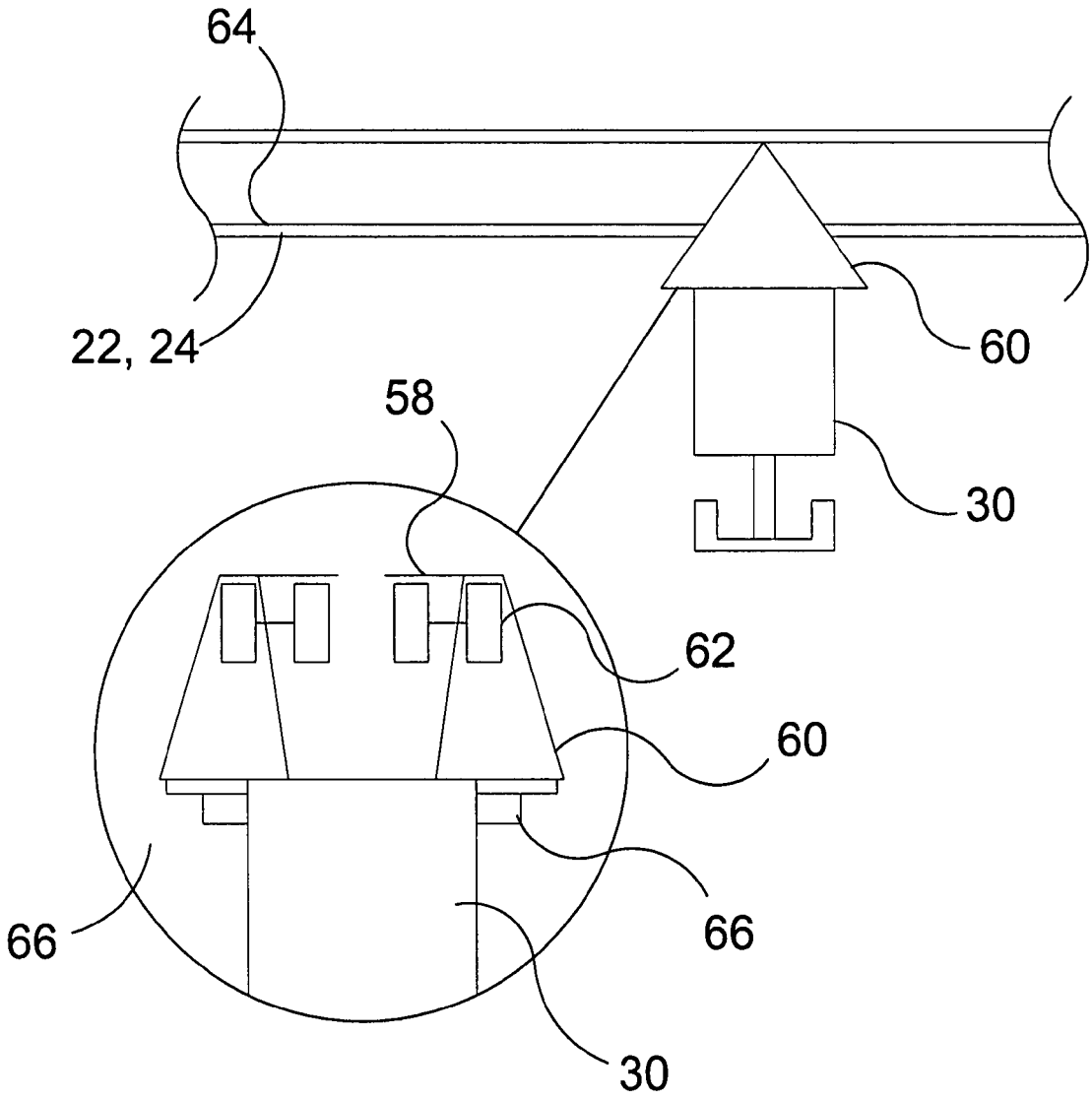
Figure 15:
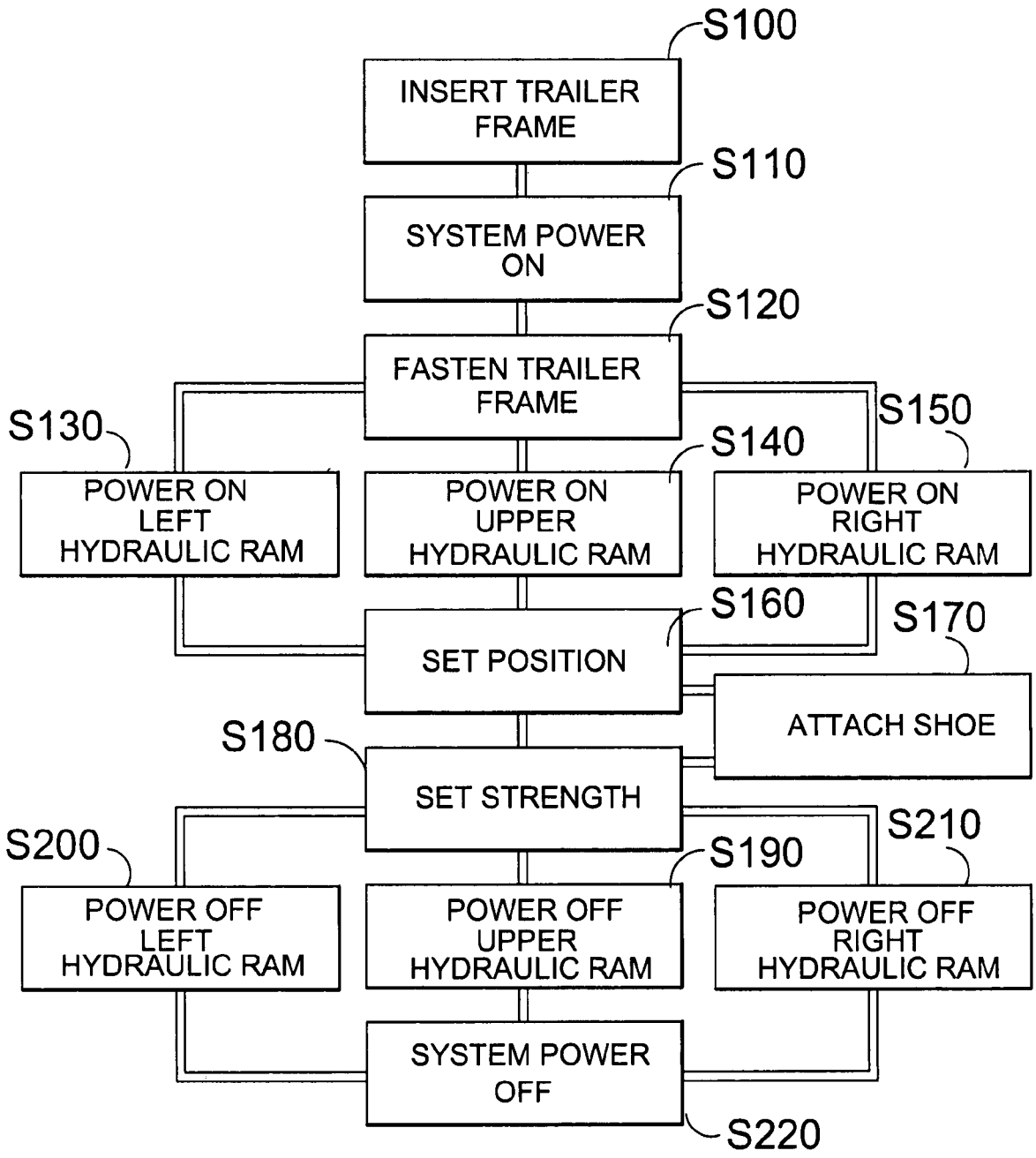

FIG. 8 an exploded view of the shoe of the frame straightening device of the present invention;

FIG. 9 an assembled view of the shoe of the frame straightening device of the present invention;

FIG. 10 is an assembled view of the shoe of the frame straightening device of the present invention in use;

FIG. 11 is an enlarged view of a frame straightening anchor of the present invention;

FIG. 12 is an illustrative view of an alternate embodiment of the frame straightening device of the present invention in use;

FIG. 13 is an illustrative view of the control box of the frame straightening device of the present invention;

FIG. 14 is an illustrative view of the base of the hydraulic rams of the frame straightening device of the present invention; and FIG. 15 is a flow diagram of the frame straightening device of the present claimed invention.

DESCRIPTION OF THE REFERENCED NUMERALS

Turning now descriptively to the drawings, in which similar reference characters denote similar elements throughout the several views, the Figures illustrate the frame straightening device of the present invention. With regard to the reference numerals used, the following numbering is used throughout the various drawing figures.

10 Frame straightening device of the present invention
12 Cargo container
14 Trailer bed frame
15 Desired level
16 Bed frame beams
17 Vertical directional arrows
18 Floor guide
19 Horizontal directional arrows
20 Securing post
21 Pivoting directional arrows
22 Stanchion
24 Upper support beam
26 Support base plate
28 Support members
30 Hydraulic ram
32 Track
34 Anchor fastener
36 Control box
38 Shoe driver
40 Hydraulic piston engaging member
42 Hydraulic piston engaging member aperture
44 Shoe
46 Hydraulic piston engaging member screws
48 Position slide control
50 Power switch
52 Strength knob
54 Status indicator LED
56 Chain
58 Wheels
60 Base
62 Motor
64 Hydraulic ram track
66 Pivoting motor

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 15 illustrate the frame straightening device of the present invention which is indicated generally by the reference numeral 10.

In the motor vehicle industry it is known that trailer frames bend out of shape over time due to heavy loads and wear. It is desirable to have a device to easily fix the bent frame of a trailer rather than purchase a new trailer frame. The present invention aims to provide a system to fix bent trailer frames by bending them back into a desired shape.

Figure 1:
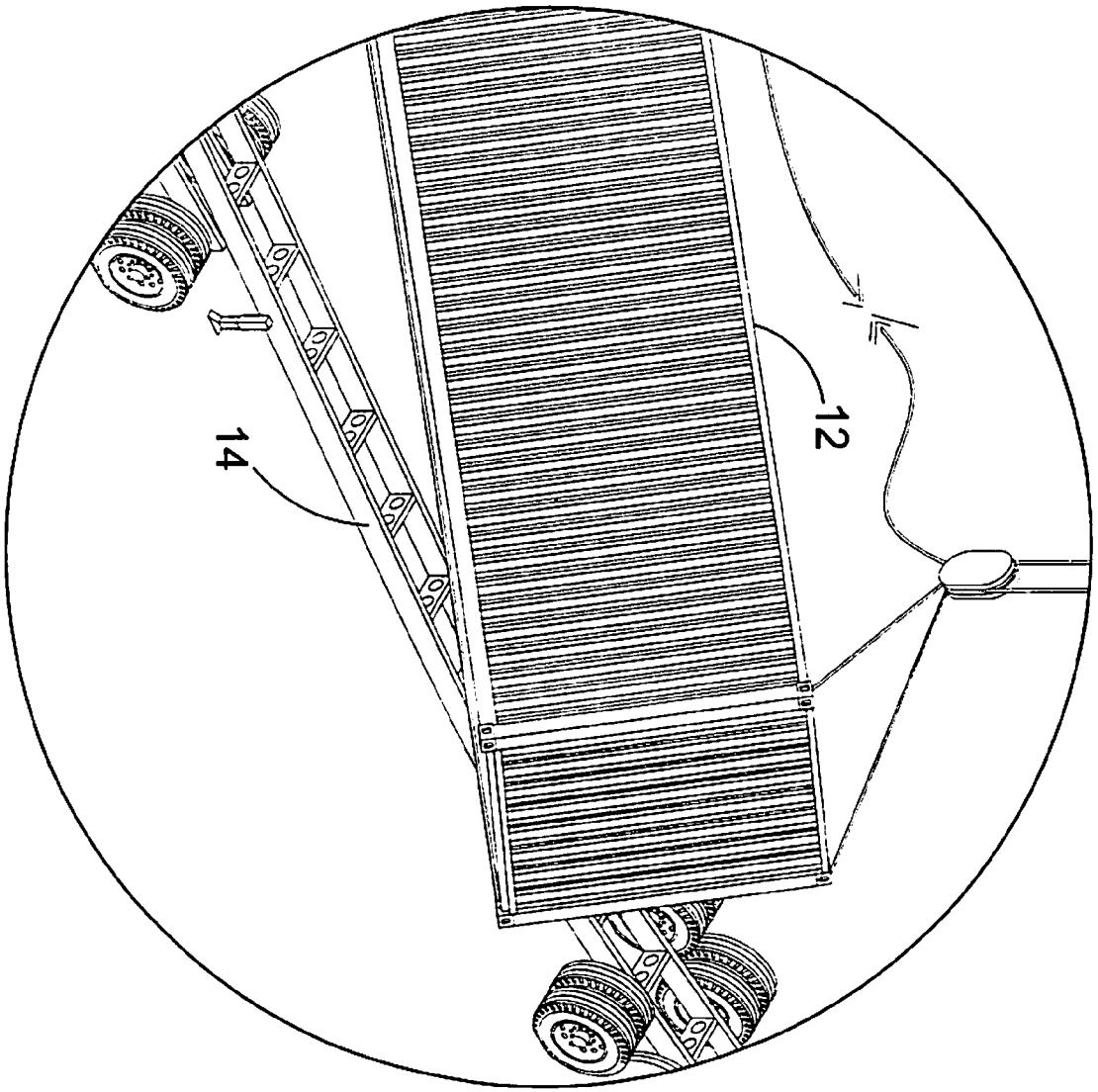
FIG. 1 is an illustrative view of the application of frame straightening device of the present invention.

FIG. 1 is an illustrative view of the application of frame straightening device of the present invention. A cargo unit 12 is transported by a trailer bed frame 14. The cargo unit 12 is generally placed onto the trailer bed frame 14 by a pulley system 13. Instances of negligence or malfunction of the pulley system 13 can cause a bending of trailer bed frame 14 out from its original and most effective state. The force of a premature drop, caused by the breaking of a pulley or negligence by its operator, of cargo unit 12 of trailer bed frame 14 will exert enough force to bend trailer bed frame 14. Additionally, the trailer bed frame 14 may bend from wear over time or transporting cargo units 12 which exceed its weight limits.

Figure 2:
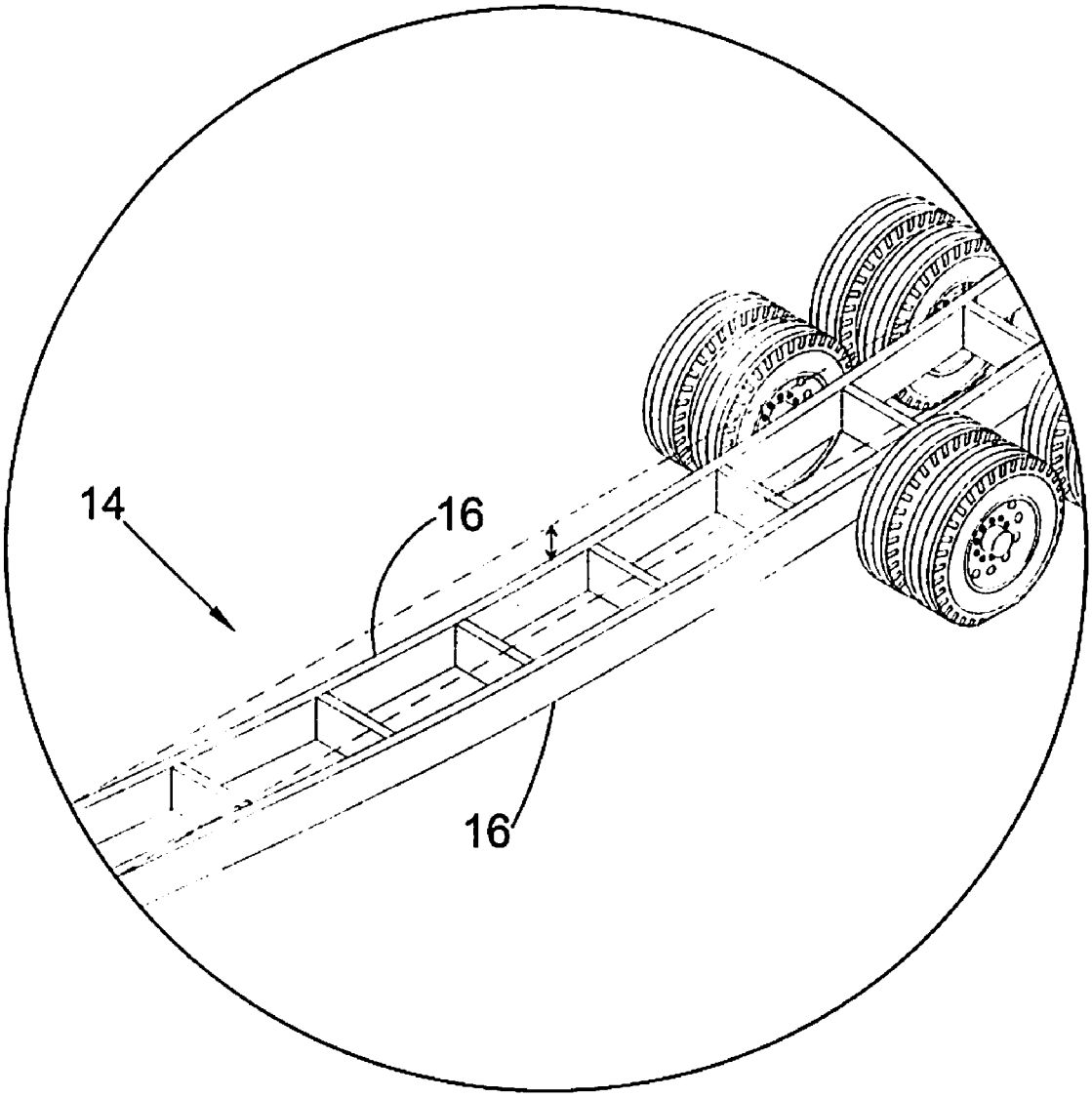
FIG. 2 is an illustrative view of the application of the frame straightening device of the present invention.

FIG. 2 is an illustrative view of the application of the frame straightening device of the present invention. Cargo unit's 12, as shown in FIG. 1, are transported by means of trailer bed frame 14. Over time the beams 16 of trailer bed frame 14 bend out of shape and the level of support the cargo unit 12 can provide is dampened. Desired level 15, shown herein as dotted lines, indicates the level at which the beams 16 of trailer bed frame 14 once were positioned. The present invention aims to bend the beams 16 of trailer bed frame 14 back the desired level 15.

Figure 3:
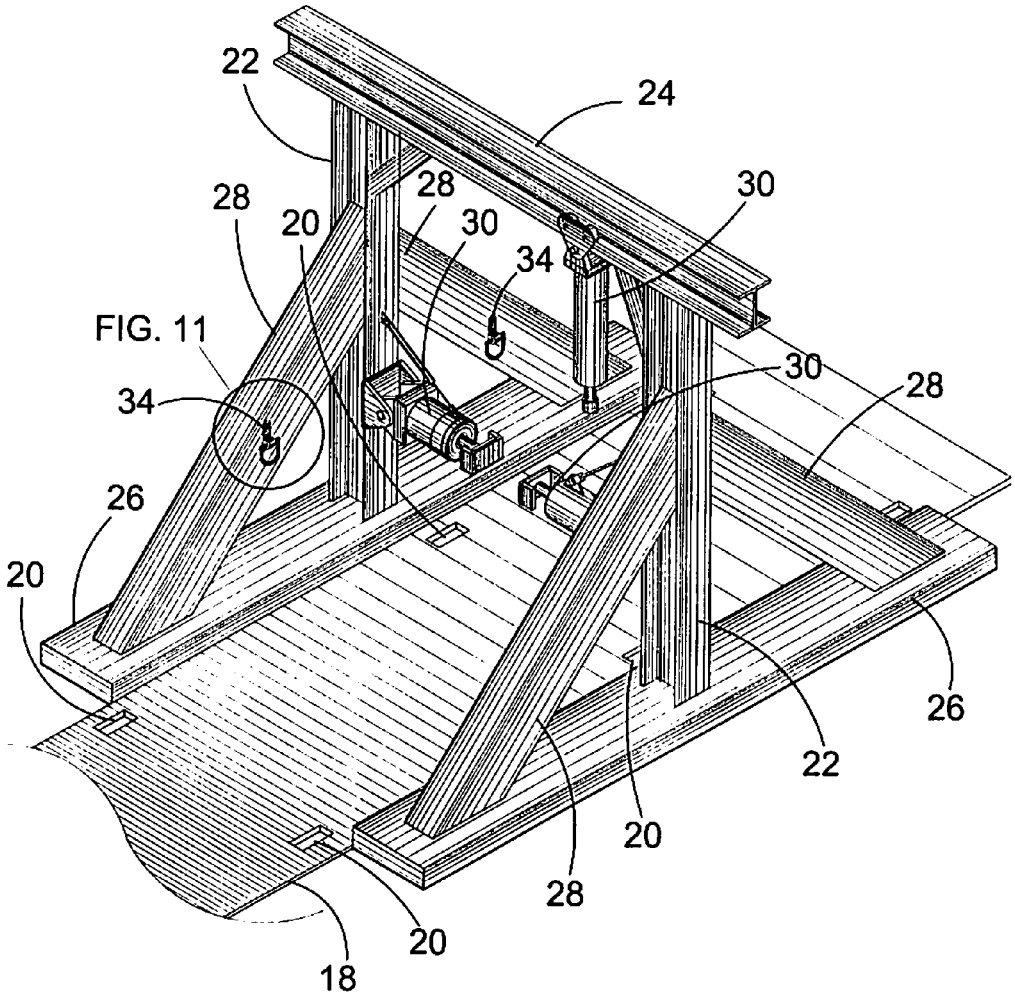
FIG. 3 is an illustrative view of the frame straightening device of the present invention.

FIG. 3 is an illustrative view of the frame straightening device of the present invention. The frame straightening device 10 of the present invention consists of a support structure, multiple hydraulic rams 30, securing devices and floor guide 18. The support structure includes support base plates 26, stanchions 22, support members 28 and an upper support 24. A support base plate 26 is located on each lateral side of the floor guide 18. A stanchion 22 is connected at a first distal end to substantially a center of each support base plate 26. A control box 34 is affixed to a respective one of the stanchion 22 to provide user inputs for system control, as will be discussed further in reference to FIG. 13. Support members 28 extend from support base plate 26 at identical angles to a predetermined location on each respective stanchion 22. Support members 28 provide equal force on each side of stanchions 22 to help create a solid supported structure. The upper support 24 is connected at each distal end thereof to a distal end of each stanchion 22 opposite the first distaldistal end. The support 24 connects both stanchions 22 to one another. This connection provides support in a direction perpendicular to the support members 28.

Both upper support beam 24 and stanchions 22 contain tracks positioned on an inner surface thereof. Hydraulic rams 30 are attached within these tracks on the stanchions 22 and upper support beam 24. The tracks are available to guide movement of the attached hydraulic ram 30 in a parallel direction along the length of the respective stanchion 22 or upper support beam 24. This connection will be discussed in detail in reference to FIG. 14. Force from the hydraulic rams 30 is exerted on trailer bed frame 14, shown in FIG. 4, to bend frame 14 into a desired shape. The forces will be discussed in greater detail in reference to FIG. 7.

A track 32 is positioned at each end of the floor guide 18. The direction of the track runs parallel to the upper support beam 24. To focus the force exerted by the hydraulic rams 30 at the center, securing posts 20 are positioned within track 32. Securing posts 20 glide along track 32 and lock into place when securing the trailer 14 therebetween. Additional support is provided by to anchor fasteners 34 which allow for attachment to the trailer 14.

Figure 4:
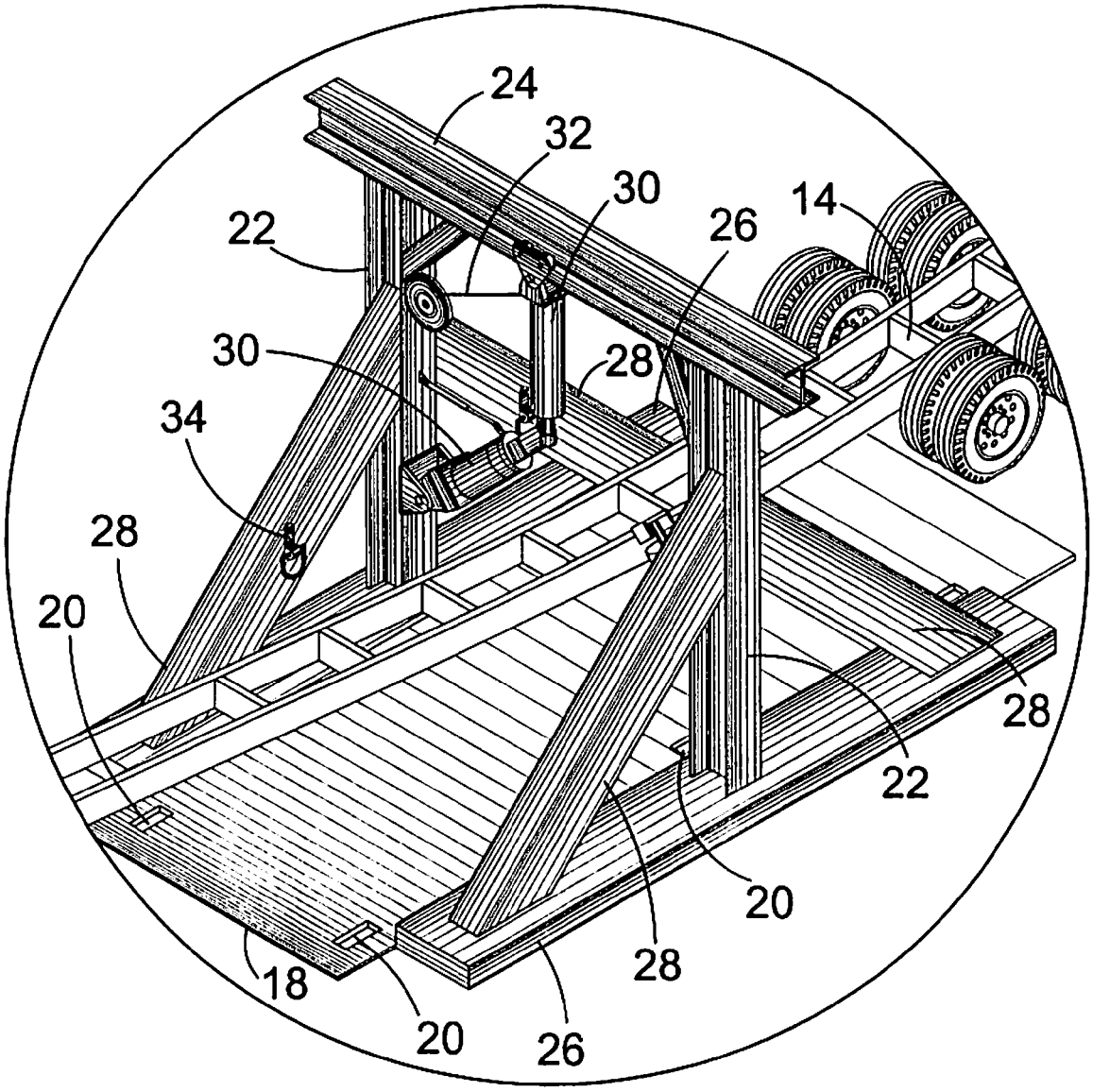
FIG. 4 is an illustrative view of the frame straightening device of the present invention with a trailer bed frame unfastened.

FIG. 4 is an illustrative view of the frame straightening device of the present invention with an unfastened trailer bed frame. The straightening device of the present invention 10 aims to correct the shape of a trailer bed frame 14 that has bent out of shape. The frame straightening device 10 of the present invention consists of a support structure, multiple hydraulic rams 30, securing devices and floor guide 18. The support structure includes support base plates 26, stanchions 22, support members 28 and the upper support 24. The support base plate 26 is located on each lateral side of floor guide 18. The stanchion 22 is connected at a first distal end to substantially a center of each support base plate 26. The control box 34 is affixed to a respective one of the stanchion 22 to provide user inputs for system control, as will be discussed further in reference to FIG. 13. Support members 28 extend from support base plate 26 at identical angles to stanchion 22 to a predetermined position on the respective stanchion 22. Support members 28 provide equal force on each side of stanchions 22 to help create a solid supported structure. The upper support 24 is connected at each distal end thereof to the distal end of each stanchion 22 opposite the first distal end. The support 24 connects both stanchions 22 to one another. This connection provides support in a direction perpendicular to the support members 28.

Both upper support beam 24 and stanchions 22 contain tracks positioned on an inner surface thereof. Hydraulic rams 30 are attached within these tracks on the stanchions 22 and upper support beam 24. When in a power off mode the hydraulic rams 30 attached to the stanchions 22 pan up to allow easy insertion of trailer bed frame 14 therebetween. The tracks are available to guide movement of the attached hydraulic ram 30 in a parallel direction along the length of the respective stanchion 22 or upper support beam 24. This connection will be discussed in detail in reference to FIG. 14. Force from the hydraulic rams 30 is exerted on trailer bed frame 14, shown in FIG. 4, to bend frame 14 into a desired shape. The forces will be discussed in greater detail in reference to FIG. 7.

A track 32 is positioned at each end of the floor guide 18. The direction of the track runs parallel to the upper support beam 24. To focus the force exerted by the hydraulic rams 30 at the center, securing posts 20 positioned within track 32. Securing posts 20 glide along track 32 and lock into place when securing trailer 14 therebetween. Additional support is provided by to anchor fasteners 34 which allow for attachment to the trailer 14. The trailer frame 14 is positioned on the floor guide 18 waiting to be secured by securing posts 20 and optional anchor fasteners 34.

Figure 5:
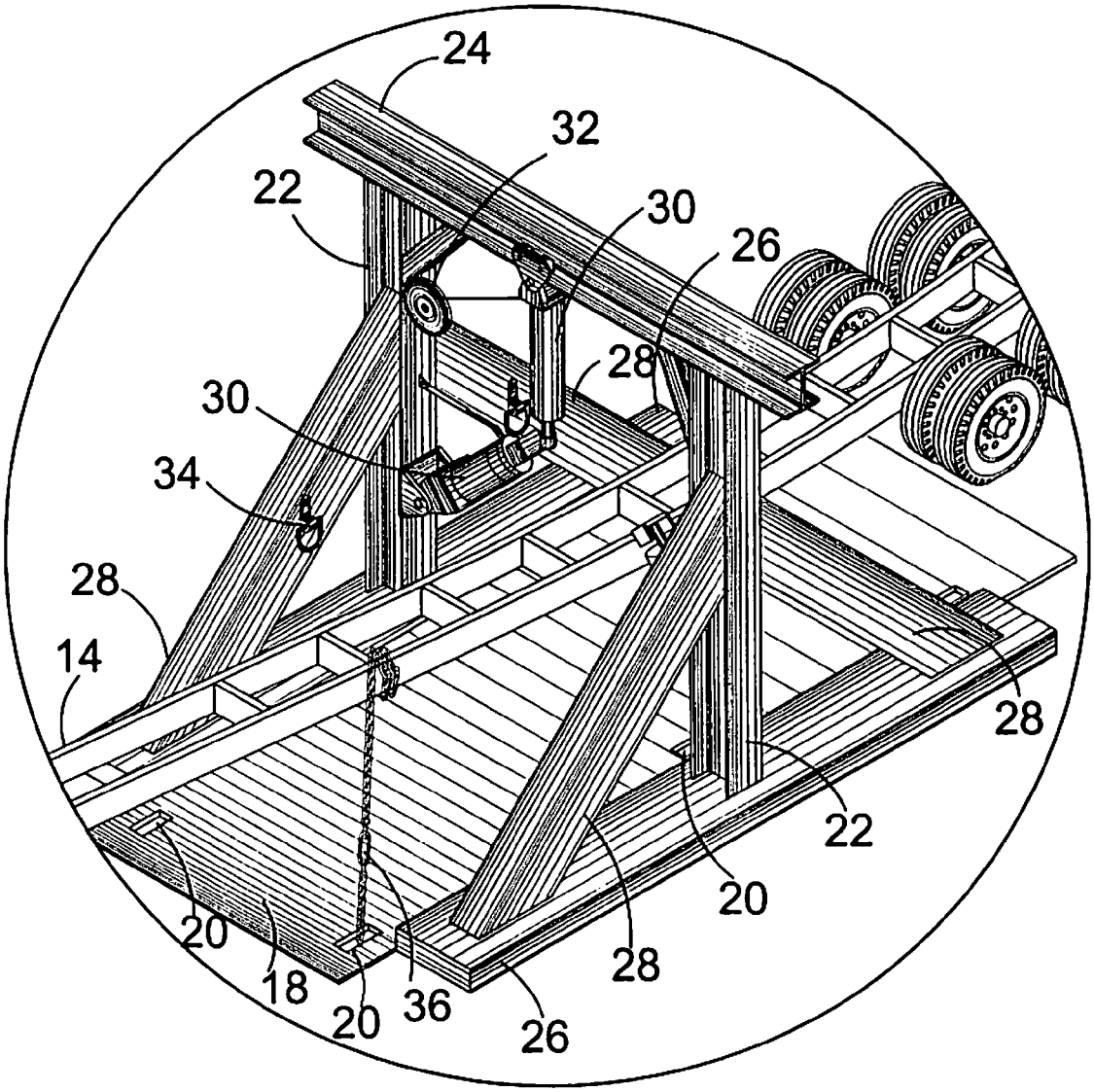
FIG. 5 is an illustrative view of the frame straightening device of the present invention with a trailer bed frame fastened.

FIG. 5 is an illustrative view of the frame straightening device of the present invention with a trailer bed frame fastened. The straightening device of the present invention 10 aims to correct the shape of a trailer bed frame 14 that has bent out of shape. The frame straightening device 10 of the present invention consists of a support structure, multiple hydraulic rams 30, securing devices and floor guide 18. The support structure includes support base plates 26, stanchions 22, support members 28 and the upper support 24. The support base plate 26 is located on each side of floor guide 18. A stanchion 22 is connected at a first distal end to substantially a center of each support base plate 26. A control box 34 is affixed to a respective one of the stanchion 22 to provide user inputs for system control, as will be discussed further in reference to FIG. 13. Support members 28 extend from support base plate 26 at identical angles to stanchion 22. Support members 28 provide equal force on each side of stanchions 22 to help create a solid supported structure. The upper support 24 is connected at each distal end thereof to a distal end of each stanchion 22 opposite the first distal end. The support 24 connects both stanchions 22 to one another. This connection provides support in a direction perpendicular to the support members 28.

Both upper support beam 24 and stanchions 22 contain tracks positioned on an inner surface thereof. Hydraulic rams 30 are attached within these tracks on the stanchions 22 and upper support beam 24. When in a power off mode the hydraulic rams 30 attached to the stanchions 22 pan up to allow easy insertion of trailer bed frame 14. The tracks are available to guide movement of the attached hydraulic ram 30 in a parallel direction along the length of the respective stanchion 22 or upper support beam 24. This connection will be discussed in detail in reference to FIG. 14. Force from the hydraulic rams 30 is exerted on trailer bed frame 14, shown in FIG. 4, to bend frame 14 into a desired shape. The forces will be discussed in greater detail in reference to FIG. 7.

A track 32 is positioned at each end of the floor guide 18. The direction of the track runs parallel to the upper support beam 24. To focus the force exerted by the hydraulic rams 30 at the center, securing posts 20 positioned within track 32. Securing posts 20 glide along track 32 and lock into place when securing trailer 14 therebetween. Additional support is provided by to anchor fasteners 34 which allow for attachment to the trailer 14. The trailer frame 14 is positioned on the floor guide 18 and fastened into a secure position by securing posts 20 and optional anchor fasteners 34. This secure position provides a stationary force against the pressure of the hydraulic rams 30.

Figure 6:
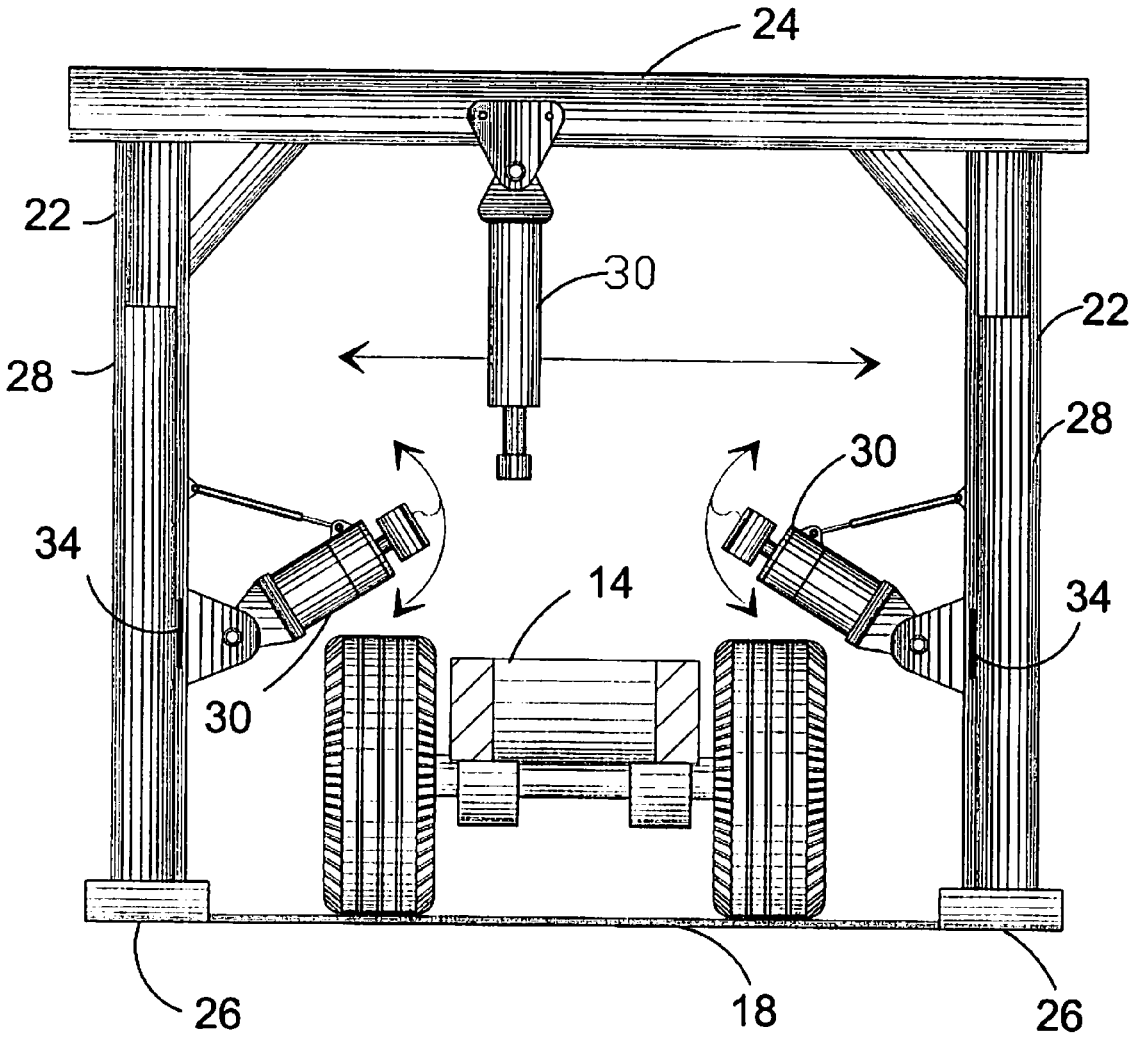
FIG. 6 is a rear view of the frame straightening device of the present invention in use.

FIG. 6 is a rear view of the frame straightening device of the present invention in use. The straightening device of the present invention 10 aims to correct the shape of a trailer bed frame 14 that has bent out of shape. The frame straightening device 10 of the present invention consists of a support structure, multiple hydraulic rams 30, securing devices and floor guide 18. The support structure includes support base plates 26, stanchions 22, support members 28 and an upper support 24. A support base plate 26 is located on each side of floor guide 18. Each stanchion 22 is connected at a first distal end to substantially a center of each support base plate 26. The control box 34 is affixed to a respective one of the stanchions 22 to provide user inputs for system control, as will be discussed further in reference to FIG. 13. Support members 28 extend from support base plate 26 at identical angles to stanchion 22 to predetermined position along the length. Support members 28 provide equal force on each side of stanchions 22 to help create a solid supported structure. The upper support 24 is connected at each distal end thereof to a distal end of each stanchion 22 opposite the first distal end. The support 24 connects both stanchions 22 to one another. This connection provides support in a direction perpendicular to the support members 28.

Force from the hydraulic rams 30 is exerted on trailer bed frame 14 to bend frame 14 into a desired shape. The forces will be discussed in greater detail in reference to FIG. 7. Hydraulic rams 30 are attached to the stanchions 22 and upper support beam 24. Both upper support beam 24 and stanchions 22 contain tracks to guide movement of the attached hydraulic ram 30 in a parallel direction. Therefore, the upper hydraulic ram 30 moves in a horizontal direction as indicated by directional arrows 19 while the side hydraulic rams 30 move in a vertical direction as indicated by directional arrows 17. The connection will be discussed in detail in reference to FIG. 14. When in a power off mode the hydraulic rams 30 attached to the stanchions 22 pan up in a direction 21 to allow for easy insertion of trailer bed frame 14.

Figure 7:
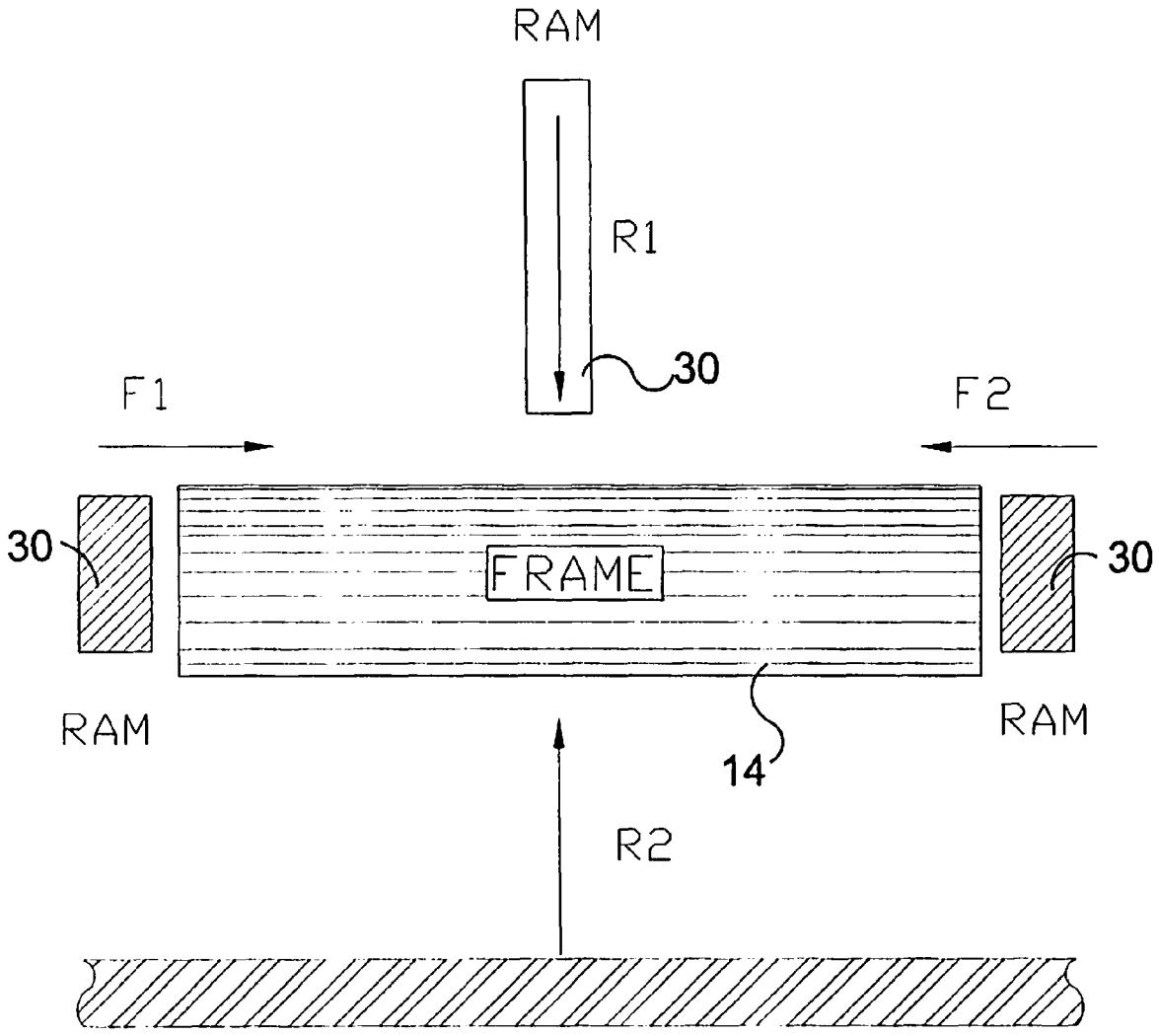
FIG. 7 is an illustrative view of the forces applied by the frame straightening device of the present invention when in use.

FIG. 7 is an illustrative view of the forces applied by the frame straightening device of the present invention when in use. The straightening device of the present invention 10, shown in FIG. 3, aims to correct the shape of a trailer bed frame 14 that has bent out of shape. Three hydraulic rams 30 exert force on trailer bed frame 14. The forces F1 and F2, provided by side hydraulic rams 30, are exerted in a horizontal direction against the stationary force of the securing post 20, shown in FIG. 3, to bend the frame 14 in a horizontal direction. The force R1, provided by upper hydraulic ram 30, is exerted in a vertical direction against the stationary force of the floor guide 18 on the wheels of trailer bed frame 14 to bend the frame 14 in a downward direction. Trailer bed frame 14 may be turned upside down in order for upper hydraulic ram 30 to provide force in an opposite vertical direction. In an alternate embodiment, not shown, a fourth hydraulic pump may be provided beneath the trailer bed frame 14 as well as supports to hold the frame down.

FIG. 8 an exploded view of a shoe 44 of the frame straightening device of the present invention. The shoe 44 is available to be attached to the end of a hydraulic ram 30, shown in FIG. 3. The shoe 44 includes a rectangular hydraulic piston engaging member 40 and a shoe driver 38. The hydraulic piston engaging member 40 is attached to the hydraulic pump 30 through hydraulic piston engaging member apertures 42. Hydraulic piston engaging member apertures 42 are located above the connection base plate of hydraulic piston engaging member 40. It is preferable that hydraulic piston engaging members 40 be attached to the ends of all hydraulic rams 30 of the present claimed invention at all times for speedier modification. The shoe driver 38 contains an elongated section to apply pressure to a greater area and a receiving connection located at the center. When it is preferable to bend a greater area, such as the span of the width of the frame 14 shown in FIG. 1, the receiving connection of shoe driver 38 is slid over the connection base plate of hydraulic engaging piston engaging member 40.

FIG. 9 an assembled view of the shoe of the frame straightening device of the present invention. The shoe 44 is available to be attached to the end of a hydraulic ram 30, shown in FIG. 3. The shoe 44 includes a rectangular hydraulic piston engaging member 40 and a shoe driver 38. The hydraulic piston engaging member 40 is attached to the hydraulic pump 30 through hydraulic piston engaging member apertures 42. Hydraulic piston engaging member apertures 42 are located above the connection base plate of hydraulic piston engaging member 40. It is preferable that hydraulic piston engaging members 40 be attached to the ends of all hydraulic rams 30 of the present claimed invention at all times for speedier modification. The shoe driver 38 contains an elongated section to apply pressure to a greater area and a receiving connection located at the center. When it is preferable to bend a greater area, such as the span of the width of the frame 14 shown in FIG. 1, the receiving connection of shoe driver 38 is slid over the connection base plate of hydraulic engaging piston engaging member 40 to create a secure connection.

FIG. 10 is an assembled view of the shoe of the frame straightening device of the present invention in use. The straightening device of the present invention 10 aims to correct the shape of a trailer bed frame 14 that has bent out of shape. The upper support beam 24 extends across the top of the straightening device 10 and provides a track for upper hydraulic ram 30. An attachable shoe 44 is attached to the end of a hydraulic ram 30. The shoe 44 includes a hydraulic piston engaging member 40 and a shoe driver 38. The hydraulic piston engaging member 40 is attached to the hydraulic pump 30 by hydraulic piston engaging member apertures 42. It is preferable that hydraulic piston engaging members 40 be attached to the ends of all hydraulic rams 30 of the present claimed invention for accelerated modification. A shoe driver 38 is slid onto hydraulic engaging piston engaging member 40 to provide a larger force area. This larger area can be used to exert simultaneous force on both bed frame beams 16 of trailer bed frame 14.

FIG. 11 is an enlarged view of a frame straightening anchor of the present invention. Anchor fasteners 34 are located on support members 28 to provide complementary support. Chains or other fastening devices may be attached to anchor fasteners 34 and a trailer bed frame 14, shown in FIG. 4, to hold the frame 14 in place when force is being exerted on it from the hydraulic rams 30, shown in FIG. 4, of the present claimed invention.

FIG. 12 is an illustrative view of an alternate embodiment of the frame straightening device of the present invention in use. The straightening device of the present invention 10 aims to correct the shape of a trailer bed frame 14 that has bent out of shape. The frame straightening device 10 of the present invention consists of a support structure, multiple hydraulic rams 30, securing devices and floor guide 18. The support structure includes support base plates 26, stanchions 22, support members 28 and an upper support 24. A support base plate 26 is located on each side of floor guide 18. A stanchion 22 is connected at a first distal end to substantially a center of each support base plate 26. A control box 34 is affixed to a respective one of the stanchion 22 to provide user inputs for system control, as will be discussed further in reference to FIG. 13. Support members 28 extend from support base plate 26 at identical angles to stanchion 22. Support members 28 provide equal force on each side of stanchions 22 to help create a solid supported structure. The upper support 24 is connected at each distal end thereof to a distal end of each stanchion 22 opposite the first distal end. The support 24 connects both stanchions 22 to one another. This connection provides support in a direction perpendicular to the support members 28.

Both upper support beam 24 and stanchions 22 contain tracks positioned on an inner surface thereof. Hydraulic rams 30 are attached within these tracks on the stanchions 22 and upper support beam 24. When in a power off mode the hydraulic rams 30 attached to the stanchions 22 pan up to allow easy insertion of trailer bed frame 14. The tracks are available to guide movement of the attached hydraulic ram 30 in a parallel direction along the length of the respective stanchion 22 or upper support beam 24. This connection will be discussed in detail in reference to FIG. 14. Force from the hydraulic rams 30 is exerted on trailer bed frame 14, shown in FIG. 4, to bend frame 14 into a desired shape. The forces will be discussed in greater detail in reference to FIG. 7.

A track 32 is positioned at each end of the floor guide 18. The direction of the track runs parallel to the upper support beam 24. To focus the force exerted by the hydraulic rams 30 at the center, securing posts 20 positioned within track 32. Securing posts 20 glide along track 32 and lock into place when securing trailer 14 therebetween. The trailer frame 14 is positioned on the floor guide 18 and fastened into a secure position by securing posts 20 and optional anchor fasteners 34. Additional support is provided by to anchor fasteners 34. Chains 56 are attached to anchor fasteners 34 and placed around trailer bed frame 14 to solidify the position of the trailer frame 14. This secure position provides a stationary force against the pressure of the hydraulic rams 30. As the hydraulic rams 30 exert pressure onto trailer frame 14 the chains 56 and securing posts 20 provide an equal and opposite force on the stationary ends of trailer 14 creating a concentration of force from the hydraulic rams 30 to a specific area.

FIG. 13 is an illustrative view of the control box of the frame straightening device of the present invention. Control box 36 contains power position slide control 48, power switches 50, strength knobs 52 and status indicator LEDs 54. The system is powered when system power switch 50 is toggled into the "on" position. Upon the toggle of system power switch 50 the system status indicator LED is activated and lights up. A set of controls is provided for each hydraulic ram 30, shown in FIG. 3. Power to each hydraulic ram 30 is provided upon the toggling of its respective power switch 50. Upon the toggle of hydraulic ram power switch 50 respective status indicator LED 54 is lit. The position of the powered hydraulic ram 30 can be adjusted using position slide controls 48. In a preferred embodiment a single position slide control 48 is provided for both side hydraulic ram control sets. The strength of pressure exerted by the powered hydraulic ram 30 is set by strength knob 52. The actual pressure exerted by powered hydraulic ram 30 is proportional to the clockwise rotation of strength knob 52. When hydraulic power switch 50 is toggled into the off position the respective hydraulic ram is powered off and its respective status LED indicator ceases to light up. When operations are complete the system is shut down by the toggling of system power switch 50. Upon the toggling of system power switch 50 system status indicator LED 54 ceases to light up.

FIG. 14 is a magnified view of the base of the hydraulic rams 30 of the present claimed invention. Hydraulic rams 30 are attached to the stanchions 22 and upper support beam 24. Both upper support beam 24 and stanchions 22 contain tracks 64 to guide movement of the attached hydraulic ram 30 in a parallel direction. Each hydraulic ram 30 is attached to a base 60 which connects the hydraulic ram 30 to the track along either stanchion 22 or upper support beam 24. The base 60 includes two motors 62 and two wheels 58. Each wheel 58 is driven by a motor 62. The wheels 58 are operable to move the base 60 along the track to which it is attached. Pivoting motors 66 are located at the end of hydraulic ram 30 to pan the hydraulic ram 30 up in a powered off position.

FIG. 15 is a flow diagram of the user process of operation of the present claimed invention. The straightening device of the present invention aims to correct the shape of a trailer bed frame that has bent out of shape. To start the frame straightening process the user first inserts the bent trailer frame onto the floor guide in step S100. The user then powers on the system in step S110. When powered, the side hydraulic rams pan downwards into a level position. The trailer frame is secured in step S120 by securing posts and fastening elements. At this point the trailer frame is ready to be straightened. Each hydraulic ram desired for use must be powered on as in steps S130, S140 and S150. Once powered, the position of the hydraulic ram can be adjusted in step S160 so the powered hydraulic ram may be at the same level as the trailer frame. A shoe may be attached to the hydraulic ram in step S170 to spread the force exerted over a larger area. Once positioned and ready, the hydraulic ram is responsive to a strength input set in step S180. This setting increases and decreases the amount of force exerted on the frailer frame from the applicable hydraulic ram. Upon the completion of use of the powered hydraulic ram, the hydraulic ram is powered off as in step S200, S190 and S210. Upon completion of the use of all hydraulic rams the system may be powered off in step S220. Upon powering the system off the side hydraulic rams pan up to make it easier to remove the trailer frame.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A device for re-shaping a trailer frame comprising:

a. a support structure for receiving said trailer frame therein;

b. means connected to said support structure for securing said trailer frame therein;

c. at least one hydraulic ram connected to and selectively moveable about said support structure for applying a predetermined force against said trailer frame;

d. a control device positioned on said support structure and connected to said at least one hydraulic ram for controlling operation thereof; wherein upon securing said trailer frame via said securing means, said at least one hydraulic ram is positioned adjacent said trailer frame and said control device is selectively operable to cause said at least one hydraulic ram to apply said predetermined force on said trailer frame thereby reshaping said trailer frame;

e. a shoe selectively connectable to a respective one of said at least one hydraulic rams at a distal end thereof for distributing said predetermined force over an increased area on said trailer frame; and f. said support structure comprises:

a floor guide;

a first base plate connected on a first lateral side of said floor guide having a first stanchion extending upwardly therefrom at substantially a center thereof;

a second base plate connected on a second lateral side of said floor base plate opposite said first guide having a second stanchion extending upwardly therefrom at substantially a center thereof;

a plurality of angular support beams angularly extending between said base plate and a predetermined position along the length of each of said first stanchion and said second stanchion; and an upper transverse support beam connecting said first stanchion with said second stanchion; wherein a receiving area is created bordered by said floor guide, said first stanchion, said second stanchion and said upper support, said receiving area is able to receive said trailer frame therein for reshaping thereof.

2. The device as recited in claim 1, wherein each of said first stanchion, said second stanchion and said upper support include a ram track positioned on a surface thereof which borders said receiving area.

3. The device as recited in claim 2, wherein said at least one hydraulic ram is connected within said track positioned on at least one of said first stanchion, said second stanchion and said upper support.

4. The device as recited in claim 2, further comprising a first hydraulic ram positioned within and moveable along said track of said first stanchion.

5. The device as recited in claim 4, further comprising a second hydraulic ram positioned within and moveable along said track of said second stanchion.

6. The device as recited in claim 5, further comprising a third hydraulic ram positioned within and moveable along said track of said upper support .

7. The device as recited in claim 6, wherein said control device allow for each of said first hydraulic ram, said second hydraulic ram and said third hydraulic ram to be operated independently from one another.

8. The device as recited in claim 1, wherein said control device allows a user to selectively determine a force to be applied by said at least one hydraulic ram.

9. The device as recited in claim 1, wherein said securing means comprises a plurality of anchor fasteners positioned on said support structure, wherein at least one chain is wrapped around said trailer frame and received through a respective one of said plurality of anchor fasteners thereby securing said trailer frame thereby.

10. The device as recited in claim 1, wherein said securing means comprises:

a first track parallel to said upper support extending along a first edge of said floor guide;

a first pair of support posts positioned within said first track and moveable along a length thereof;

a second track parallel to said upper support extending along a second edge of said floor guide opposite said first edge;

a second pair of support posts positioned within said second track and moveable along a length thereof; wherein upon positioning said trailer frame in said receiving area, each of said first support posts and said second support posts are selectively moved towards a center of said floor guide thereby pressing said trailer frame therebetween.

11. The device as recited in claim 1 wherein said control device includes at least one of power switches, position controls, strength controls and status indicators.

12. The device as recited in claim 1, wherein said at least one hydraulic ram is connected to said support structure via a base.

13. The device as recited in claim 12, wherein said base allows said at least one hydraulic ram to pivot thereabout in a direction towards said support structure.

14. The device as recited in claim 13, wherein said base comprises a motor causing said at least one hydraulic ram to pivot thereabout.

15. The device as recited in claim 12, wherein said base comprises a movement motor and wheels received by said support structure for moving said at least one hydraulic ram thereabout.

* * * * *